US007506772B2

(12) United States Patent
Chen

(10) Patent No.: US 7,506,772 B2
(45) Date of Patent: Mar. 24, 2009

(54) WALL-MOUNT RACK

(75) Inventor: Henry Chen, Taipei (TW)

(73) Assignee: Protrend Co., Ltd., Taipei (TW)

( * ) Notice: Subject to any disclaimer, the term of this patent is extended or adjusted under 35 U.S.C. 154(b) by 319 days.

(21) Appl. No.: 11/385,848

(22) Filed: Mar. 22, 2006

(65) Prior Publication Data

US 2007/0221595 A1 Sep. 27, 2007

(51) Int. Cl.
*A47H 1/00* (2006.01)

(52) U.S. Cl. ..... 211/103; 211/190; 211/207; 403/294; 312/247

(58) Field of Classification Search ..... 211/103, 211/207, 106, 190, 189, 87.01, 86.01, 90.02, 211/175, 119.004, 187, 192, 195, 188, 194, 211/191; 248/218.4, 220.21, 220.41, 224.8, 248/225.21, 327; 403/392, 294, 293, 286; 52/848, 36.6, 36.4, 36.5, FOR. 116, FOR. 117, 52/FOR. 118; 312/247
See application file for complete search history.

(56) References Cited

U.S. PATENT DOCUMENTS 379,688 A * 3/1888 Dennis ..... 52/514
2,772,846 A * 12/1956 Skar ..... 248/243
2,821,154 A * 1/1958 Tennison, Jr. ..... 405/122
3,184,068 A * 5/1965 Wende ..... 211/23
3,671,062 A * 6/1972 Ashworth ..... 403/292
3,729,113 A * 4/1973 Lopatka ..... 220/480
3,733,755 A * 5/1973 Butler ..... 52/36.6
3,900,269 A * 8/1975 Pavlot ..... 403/292
3,993,002 A * 11/1976 Stroh ..... 108/108
4,516,874 A * 5/1985 Yang et al. ..... 403/313
4,550,893 A * 11/1985 Wiersema et al. ..... 248/224.8
5,350,073 A * 9/1994 Thornley et al. ..... 211/187
5,472,103 A * 12/1995 Merl ..... 211/187
5,655,740 A * 8/1997 Lazarus ..... 248/243
5,988,409 A * 11/1999 Gusdorf et al. ..... 211/90.01
6,726,034 B2 * 4/2004 Holbrook et al. ..... 211/87.01
6,932,225 B2 * 8/2005 Rowe ..... 211/90.02
7,255,237 B2 * 8/2007 Stitchick et al. ..... 211/106
7,296,697 B2 * 11/2007 Costa et al. ..... 211/175
7,314,144 B2 * 1/2008 Stitchick et al. ..... 211/125
7,387,212 B2 * 6/2008 Costa et al. ..... 211/90.01
7,392,911 B2 * 7/2008 Stitchick et al. ..... 211/90.02
2003/0233965 A1 * 12/2003 Brazier ..... 108/108
2003/0234231 A1 * 12/2003 Rowe ..... 211/90.02
2005/0109720 A1 * 5/2005 Marchetta ..... 211/87.01
2005/0145147 A1 * 7/2005 Costa et al. ..... 108/108
2005/0145588 A1 * 7/2005 Stitchick et al. ..... 211/183
2005/0150850 A1 * 7/2005 Stichick et al. ..... 211/90.03
2006/0096939 A1 * 5/2006 Liu ..... 211/189
2006/0113443 A1 * 6/2006 Remmers ..... 248/235

* cited by examiner

*Primary Examiner*—Lanna Mai
*Assistant Examiner*—Stanton L. Krycinski
(74) *Attorney, Agent, or Firm*—Troxell Law Office, PLLC

(57) ABSTRACT

A wall-mount rack includes at least two vertical posts, at least two hangers, and at least one container. Each of the vertical posts is provided on two lateral sides with one longitudinal row of holes each. The hangers are hooked to two corresponding holes at the same level on two opposite inner lateral sides of the two vertical posts. The container is hung on the two hangers and thereby stably mounted on and between the two vertical posts. The container may be a box-type container to define a receiving space therein.

6 Claims, 6 Drawing Sheets

WALL-MOUNT RACK

FIELD OF THE INVENTION

The present invention relates to a wall-mount rack, which allows a container to be quickly mounted to and between two vertical posts at a suspended position.

BACKGROUND OF THE INVENTION

For the purpose of effectively holding things in limited room, there is developed a wall-mount rack. A general wall-mount rack includes a horizontal crossbar and a plurality of vertical posts. The horizontal crossbar is horizontally fixed to a wall surface high from the ground or floor, and the vertical posts are hung on the crossbar to parallelly space from one another and perpendicular to the ground of floor. The vertical post is provided on a front side with a row of holes, into which a supporting bracket is inserted, so that a metal wire shelf may be supported on two horizontally corresponding supporting brackets for holding things thereon. U.S. Pat. Nos. D490,697; 3,701,325; and 5,110,080 disclose wall-mount racks having the above-described structure.

Generally, the components that can be mounted on the above wall-mount rack for holding things include metal wire shelves, flat wooden shelves, drawer-type baskets, etc., which normally define an open space for holding things, so that things laid thereon are readily observed to present a disorder and unpleasant view. When it is desired to mount a box-type container on the vertical posts, the container would occupy the holes provided on the front sides of the vertical posts. Therefore, there are no holes available for mounting another container or shelf to another side of the vertical posts at the same height.

It is therefore tried by the applicant to develop an improved wall-mount rack to overcome the drawbacks in the conventional wall-mount rack.

SUMMARY OF THE INVENTION

A primary object of the present invention is to provide a wall-mount rack, which allows a box-type container to be mounted on and between two adjacent vertical posts at a suspended position.

In the wall-mount rack of the present invention, each of the vertical posts is provided at two lateral sides with a longitudinal row of holes each, to which the box-type container is hung without occupying holes provided on a front side of the vertical post.

In a preferred embodiment, the wall-mount rack of the present invention includes at least two vertical posts, at least two hangers, and at least one container. The vertical posts are parallelly fixed to a wall surface, so that they are spaced from each other with a predetermined distance and perpendicular to the ground or floor. Each of the two vertical posts is provided on two lateral sides with one longitudinal row of holes each. The hangers are hooked to two corresponding holes at the same level on two opposite inner lateral sides of the two vertical posts. The container is hung on the two hangers and thereby stably mounted on and between the two vertical posts.

In an embodiment of the present invention, the container is a box-type container.

With the above arrangements, the box-type container in the wall-mount rack of the present invention can be very easily and conveniently hung on the two vertical posts, which are fixed to a wall surface.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein

FIG. 2-1 an enlarged view of the circled area of FIG. 2;

FIG. 3-1 is an enlarged view of the circled area of FIG. 3;

DETAILED DESCRIPTION OF THE PREFERRED EMBODIMENTS

Figure 1:
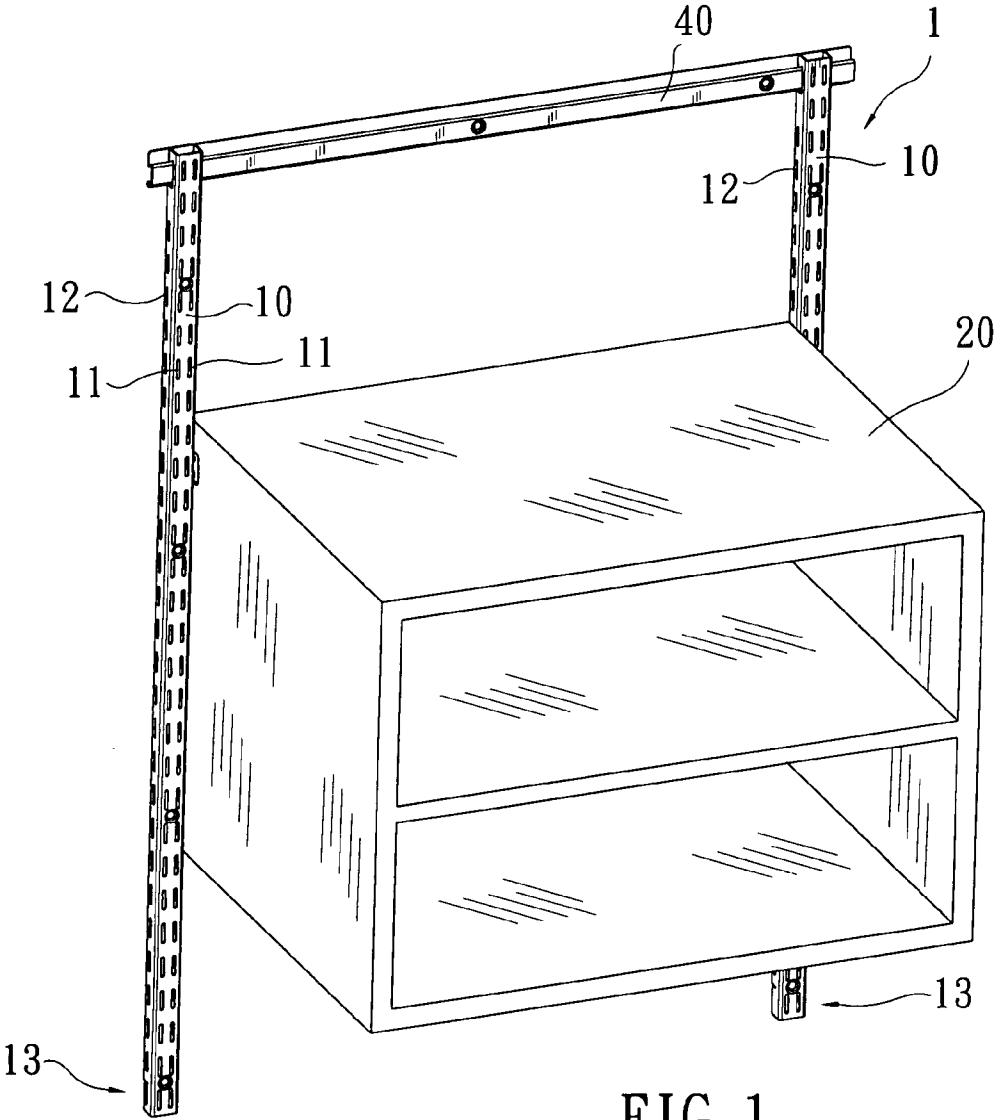
FIG. 1 is an assembled front perspective view showing a wall-mount rack according to a first embodiment of the present invention.
Figures 1, 2:
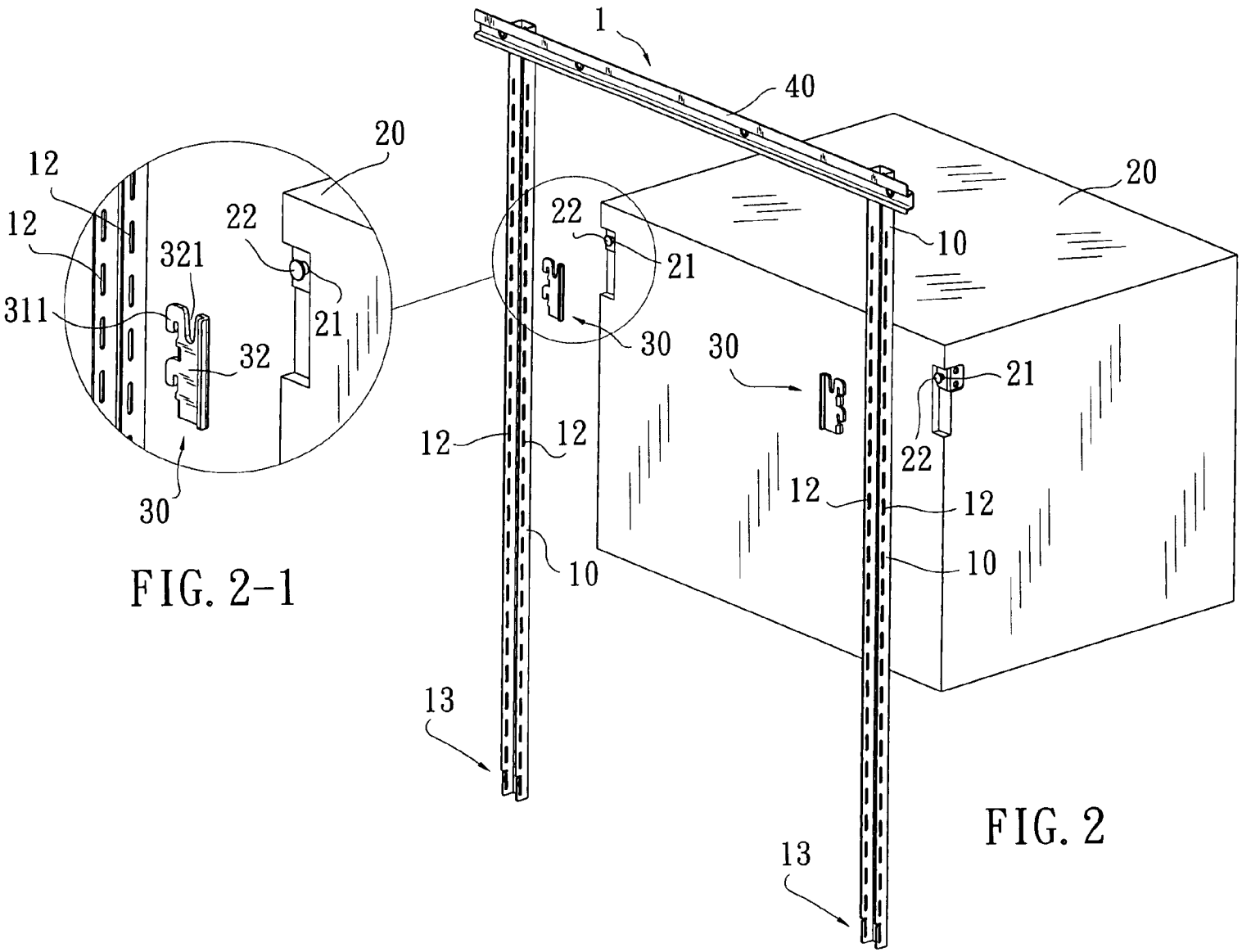
FIG. 2 is an exploded rear perspective view of FIG. 1.

Please refer to FIGS. 1 and 2, in which a wall-mount rack 1 according to a first embodiment of the present invention is shown. As shown, the wall-mount rack 1 in the first embodiment includes at least two vertical posts 10, at least two hangers 30, and at least one container 20. The two hangers 30 are separately hung on the two vertical posts 10, and the container 20 is hung on the two hangers 30 to thereby mount on the vertical posts 10.

The vertical post 10 is a U-sectioned post defining a front side, two lateral sides, and a rear open side.

Two longitudinal rows of spaced holes 11 are formed on the front side and one longitudinal row of space holes 12 are correspondingly formed on each lateral side of the vertical post 10. The vertical posts 10 are fixed to a wall surface with the rear open side facing toward the wall surface.

Figures 1, 3:
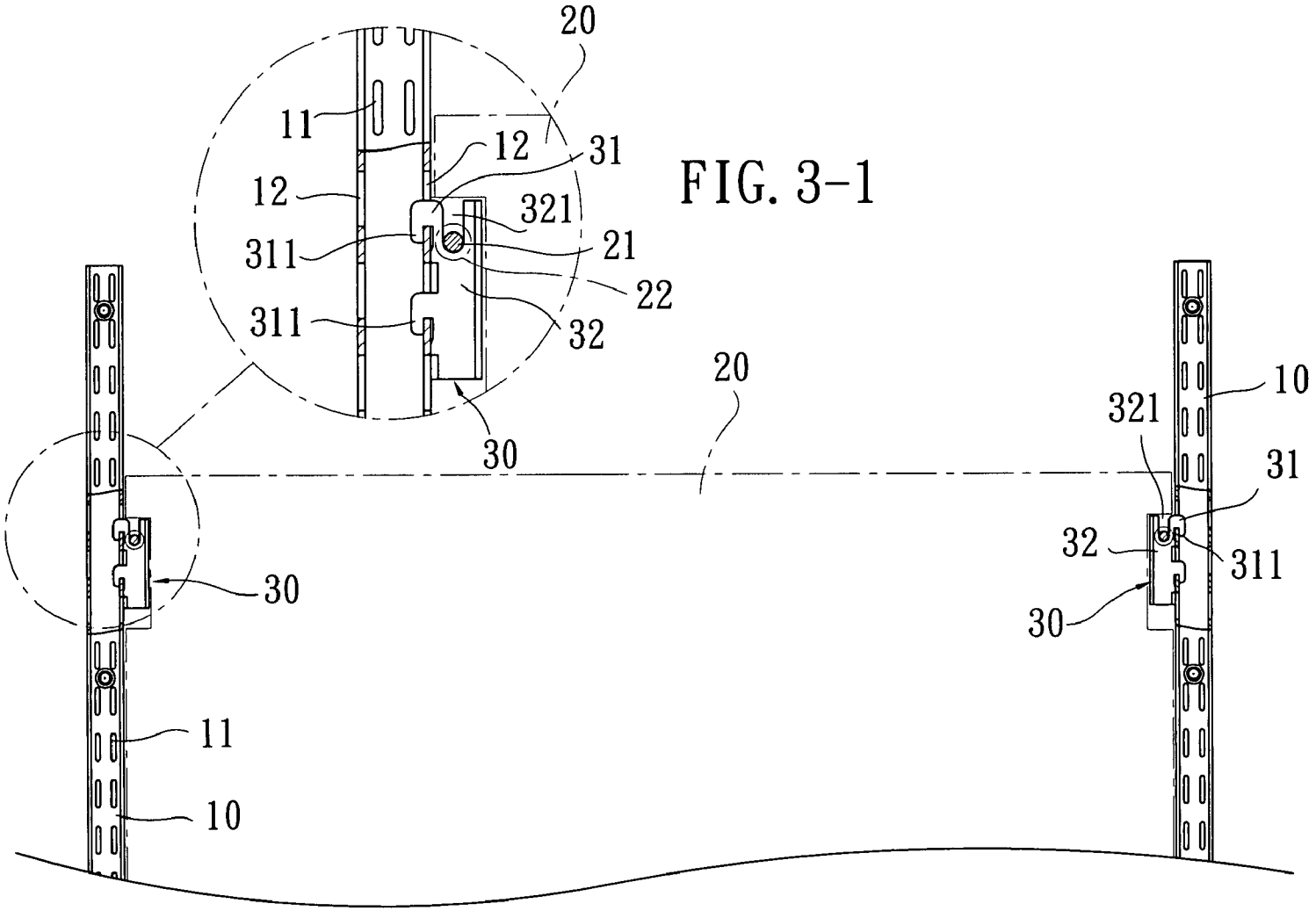
FIG. 3 is a partially cutaway sectional view of the wall-mount rack of FIG. 1.

The hanger 30 is formed from a flat plate and includes an outer hook portion 31 and an inner slot portion 32. The hook portion 31 includes at least one downward extended hook 311, and the slot portion 32 includes an open-topped slot 321. The two hangers 30 are hung on the two vertical posts 10 by separately extending the hooks 311 thereof into two holes 12 at the same height on two opposite inner lateral sides of the two vertical posts 10, as shown in FIG. 3.

The container 20 is a box in the illustrated first embodiment of the present invention to include a case defining an inner space for receiving things therein. As can be seen from FIGS. 2 and 2-1, the container 20 is symmetrically provided at two rear lateral ends near a top thereof with two rearward projected pins 21. The pins 21 have a free end formed into a diametrically expanded head 22, and the head 22 has an outer diameter larger than a width of the open-topped slot 321 on the hanger 30. The container 20 is mounted to the two vertical posts 10 by resting the two pins 21 on the slots 321 of the two hangers 30 with the expanded heads 22 located behind the slot portions 32 of the hangers 30, as shown in FIGS. 3 and 3-1

The two vertical posts 10 are connected at an upper end to a horizontal crossbar 40, so that the vertical posts 10 are parallel to each other and perpendicular to the ground or floor, and two holes 11 or 12 correspondingly formed on the two vertical posts 10 are at the same level. Since this is a known skill, it is not described in details herein.

The box-type container 20 has an overall width slightly smaller than and very close to a distance between the two vertical posts 10, so that the container 20 could be stably mounted on and between the two vertical posts 10 with the two opposite inner lateral sides of the two vertical posts 10 fitly bearing against two lateral sides of the container 20.

Figure 4:
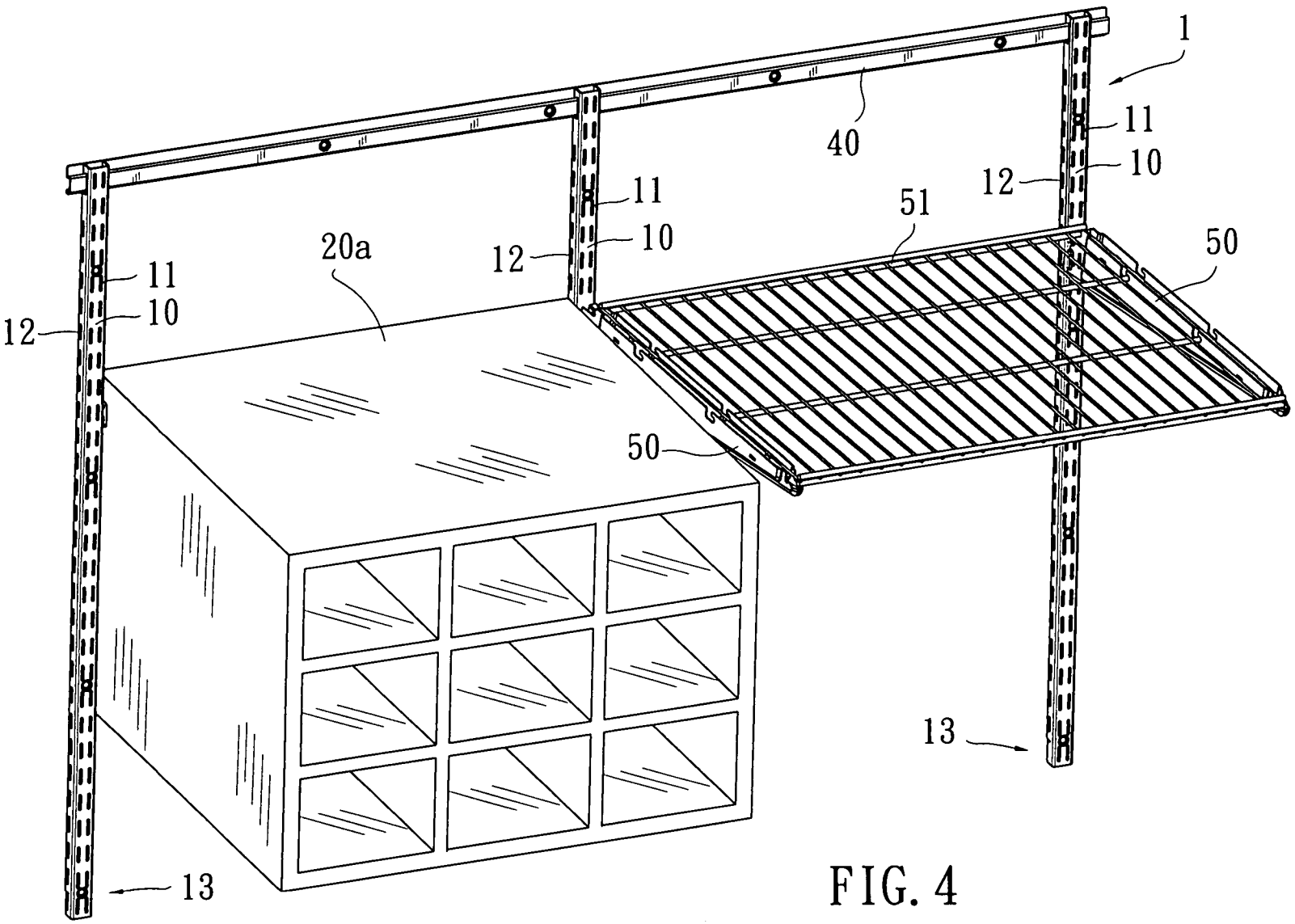
FIG. 4 is an assembled front perspective view of a wall-mount rack according to a second embodiment of the present invention.
Figure 5:
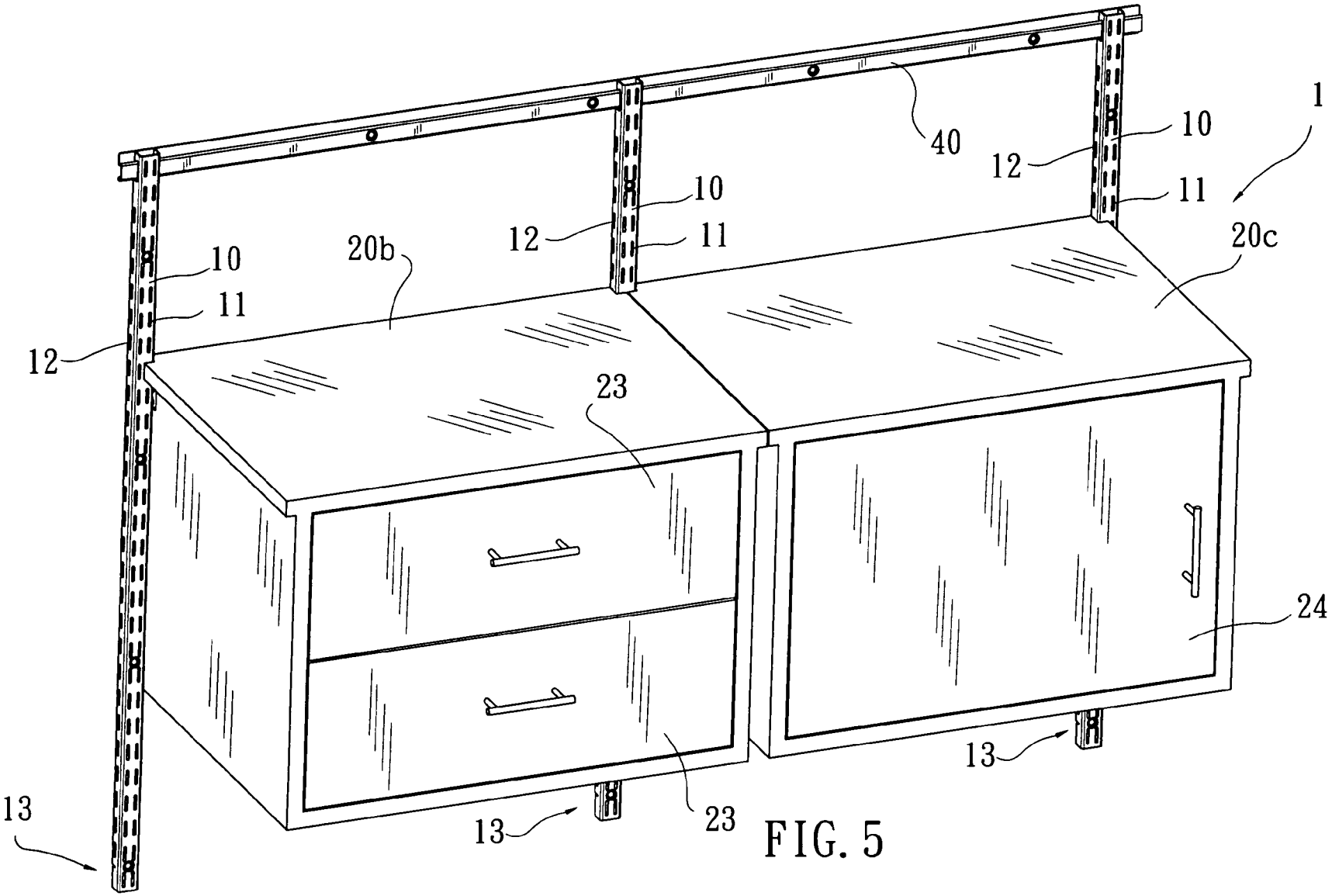
FIG. 5 is an assembled front perspective view of a wall-mount rack according to a third embodiment of the present invention.

In the first embodiment of the present invention, the inner space of the box-type container 20 is divided into two layers. In a second embodiment of the present invention as shown in FIG. 4, the wall-mount rack 1 includes a box-type container 20*a* having an inner space divided into more than two subspaces. And, in a third embodiment of the present invention as shown in FIG. 5, the wall-mount rack 1 includes a box-type container 20*b* including a plurality of drawers 23, and a box-type container 20*c* provided with a front door 24. Since there is a wide choice of box-type containers 20, 20*a*, 20*b*, 20*c* providing differently divided subspaces, the wall-mount rack 1 of the present invention is more convenient and practical for use.

When the box-type container 20 is mounted on the rack 1, only the holes 12 at the inner lateral sides of the two vertical posts 10 are occupied. The holes 11 at the front sides of the vertical posts 10 are still available, so that other types of brackets 50 may still be connected thereto to support other types of holding members, such as a metal wire shelf 51 shown in FIG. 4.

Figure 6:
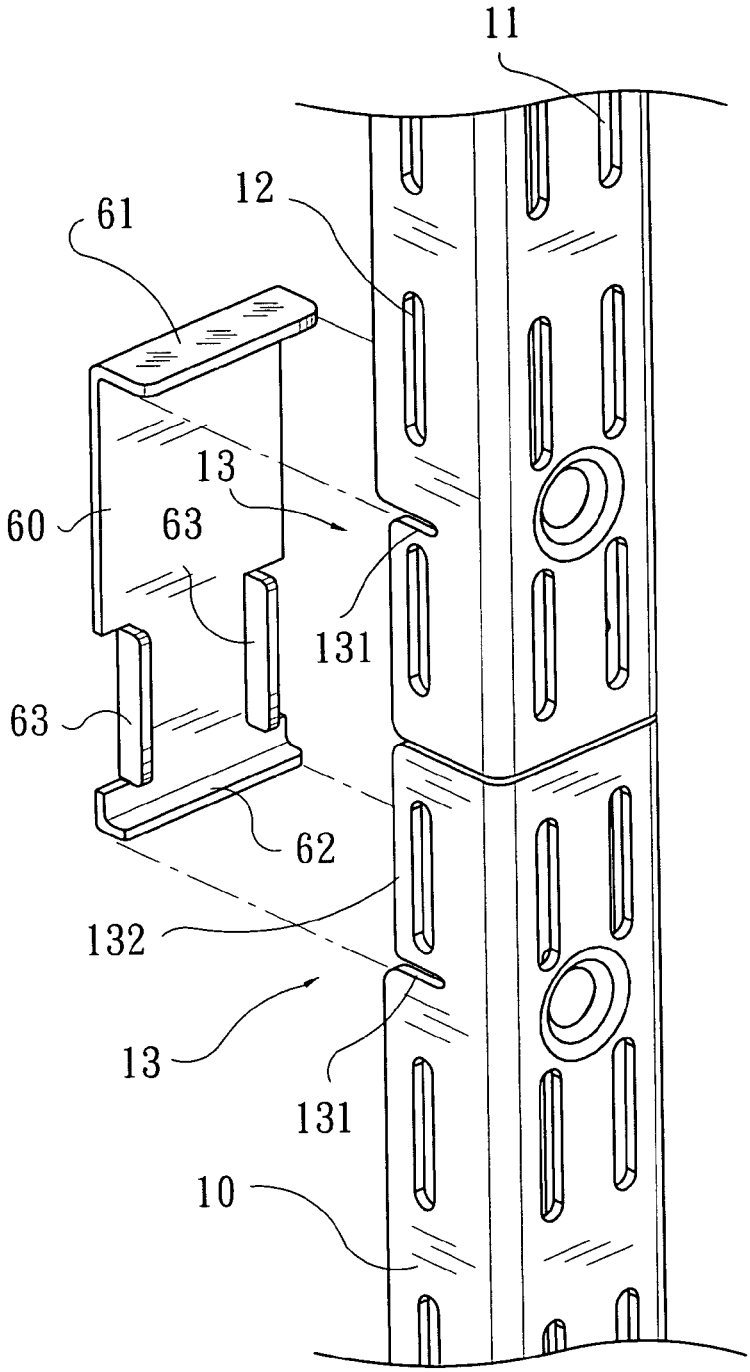
FIG. 6 is an exploded front perspective view showing the connection of two vertical posts for the wall-mount rack of the present invention.
Figure 7:
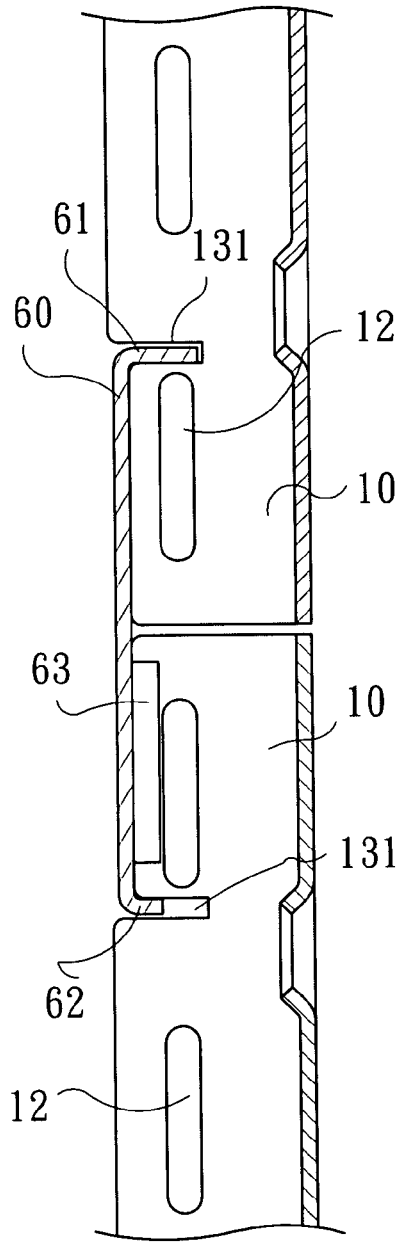
FIG. 7 is an assembled sectioned side view of FIG. 6.

Please refer to FIGS. 6 and 7. Each of the vertical posts 10 is provided at a lower end with a connecting means 13. The connecting means 13 includes two horizontal narrow slits 131 correspondingly formed on the two lateral sides of the vertical post 10, and a receded section 132 immediately below each of the horizontal slits 131. Two aligned vertical posts 10 could be connected end to end utilizing the connecting means 13 and a separate coupling bracket 60 to create an increased overall length for the vertical post of the wall-mount rack 1.

The coupling bracket 60 includes an upper and a lower horizontal end wall 61, 62, and is provided at two lateral edges of a lower half with a forward extended side wall 63 each. All the end walls 61, 62 and the side walls 63 are extended forward. The receded sections 132 below the slits 131 of the vertical post 10 have a depth slightly larger than a material thickness of the coupling bracket 60. It is noted a lower one of the two aligned vertical posts 10 is in an inverted position, and the upper one of the two aligned vertical posts 10 is fixed to a wall surface prior to connecting with the lower vertical post 10. To connect the lower vertical post 10 to the upper one, which has already been fixed to the wall surface, first sidewardly slide the coupling bracket 60 into a gap between the wall surface and the receded sections 132 at the lower end of the upper vertical post 10, so that the horizontal upper end wall 61 of the coupling bracket 60 is located in the horizontal slits 131 of the upper vertical post 10. Then, align the horizontal slits 131 of the lower vertical post 10 with the horizontal lower end wall 62 of the coupling bracket 60, so that the lower vertical post 10 is correctly located below and aligned with the upper vertical post 10. Finally, fix the lower vertical post 10 to the wall surface. At this point, the two forward extended side walls 63 of the coupling bracket 60 are pressed against inner surfaces of the two lateral sides of the lower vertical post 10. Since the vertical post 10 is fixed to the wall surface in a known manner, it is not described in details herein.

In brief, the wall-mount rack 1 of the present invention allows a container 20 to be mounted between two vertical posts 10 utilizing the holes 12 provided on two opposite inner lateral sides of the two vertical posts 10, so that the holes 11 provided on the front side of the vertical posts 10 are still available for connecting other types of shelves to the vertical posts 10. Moreover, there is a wide choice of box-type containers 20 having differently designed internal spaces. Therefore, the wall-mount rack 1 of the present invention is apparently more changeful and practical for use.

What is claimed is:

1. A wall-mount rack comprising: at least two vertical posts, at least two hangers, and at least one container;

each of said vertical posts being a U-sectioned post defining a front side, two lateral sides, and a rear open side facing toward a wall surface, to which said vertical posts are fixed; said front side of said vertical post being provided with at least one longitudinal row of holes, and each of said two lateral sides of said vertical post being correspondingly provided with one longitudinal row of holes;

said hangers hooked to said holes correspondingly provided on said two lateral sides of said two vertical posts; and said container hung on said two hangers and thereby stably mounted on and between said two vertical posts, wherein each of said vertical posts is provided at a lower end with a connecting means, whereby one of said at least two vertical posts defining an upper post and another one of said at least two vertical posts defining and inverted lower post aligned with each other and connected end to end by engaging a separate coupling bracket with said connecting means on said two aligned vertical posts, wherein said connecting means includes two horizontal slits provided on the two lateral sides of each said vertical post, and a receded section immediately below each of said horizontal slits; and wherein said coupling bracket includes a planar member, an upper and a lower horizontal end wall that extend forward from said planar member, and is provided at two lateral edges of a lower half of said planar member with a forward extended side wall; and said coupling bracket being engaged with said connecting means by moving the upper end wall of said coupling bracket into said slits of said upper vertical post and the lower end wall of said coupling bracket into said slits of said inverted lower vertical post, so that the two side walls of said coupling bracket are pressed against inner surfaces of said two lateral sides of said lower vertical post.

2. The wall-mount rack as claimed in claim 1, wherein each of said hangers is formed from a flat plate and includes an outer hook portion and an inner slot portion; said outer hook portion including at least one downward extending hook, and said inner slot portion including an open-topped slot; said two hangers being connected to said two vertical posts by extending said at least one downward extending hook into one of said holes on one of the respective lateral sides of one of the respective vertical posts such that said hangers are facing each other at the same level; and wherein said container is provided at each of two rear lateral ends at an upper portion therof with a rearward projected pin, and said container being hung on each of said hangers by resting a respective one of said pins on said open-topped slot provided on each of said hangers.

3. The wall-mount rack as claimed in claim 2, wherein each of said pins provided on said container has a free end formed into a diametrically expanded head, and said head has an outer diameter larger than a width of said open-topped slot on said hanger.

4. The wall-mount rack as claimed in claim 2, wherein said container is a box-type container including a case defining a receiving space therein.

5. The wall-mount rack as claimed in claim 4, wherein said box-type container fits between said two vertical post.

6. The wall-mount rack as claimed in claim 1, wherein each of said receded sections below said slits on said vertical post has a depth larger than the thickness of said planar member of said coupling bracket.

* * * * *